US011092293B2

(12) United States Patent
Moioli et al.

(10) Patent No.: US 11,092,293 B2
(45) Date of Patent: Aug. 17, 2021

(54) MODULAR LIGHTING SYSTEM

(71) Applicant: ARTEMIDE S.p.A., Milan (IT)

(72) Inventors: Daniele Moioli, Milan (IT); Andrea Gallucci, Guanzate (IT); Paolo Leoni, Milan (IT)

(73) Assignee: ARTEMIDE S.p.A.

( * ) Notice: Subject to any disclaimer, the term of this patent is extended or adjusted under 35 U.S.C. 154(b) by 15 days.

(21) Appl. No.: 15/483,631

(22) Filed: Apr. 10, 2017

(65) Prior Publication Data

US 2017/0292661 A1 Oct. 12, 2017

(30) Foreign Application Priority Data

Apr. 11, 2016 (IT) ..... 202016000037051

(51) Int. Cl.

| | |
|---|---|
| ***F21S 4/00*** | (2016.01) |
| ***F21S 2/00*** | (2016.01) |
| ***F21V 21/35*** | (2006.01) |
| ***F21V 21/14*** | (2006.01) |
| ***F21V 21/096*** | (2006.01) |
| ***F21S 8/06*** | (2006.01) |
| ***F21S 4/28*** | (2016.01) |
| ***F21V 15/01*** | (2006.01) |
| ***F21V 21/005*** | (2006.01) |

(Continued)

(52) U.S. Cl.

CPC ..... *F21S 2/005* (2013.01); *F21S 4/28* (2016.01); *F21S 8/066* (2013.01); *F21V 15/01* (2013.01); *F21V 21/005* (2013.01); *F21V 21/096* (2013.01); *F21V 21/14* (2013.01); *F21V 21/35* (2013.01); *F21S 8/061* (2013.01); *F21Y 2113/20* (2016.08); *F21Y 2115/10* (2016.08)

(58) Field of Classification Search

CPC .... F21S 2/005; F21S 4/28; F21S 8/066; F21S 8/061; F21S 8/037; F21S 8/043; F21S 10/026; F21S 8/06; F21V 21/35; F21V 21/14; F21V 21/096; F21V 15/01; F21V 21/005; F21V 21/30; F21V 21/26; F21V 21/29; F21Y 2115/10; F21Y 2113/20

See application file for complete search history.

(56) References Cited

U.S. PATENT DOCUMENTS 5,672,003 A * 9/1997 Shemitz ..... F21S 2/00 248/214
7,758,358 B1 * 7/2010 Mier-Langner ..... H01R 25/142 362/219

(Continued)

FOREIGN PATENT DOCUMENTS

| | | |
|---|---|---|
| DE | 19641090 | 4/1997 |
| EP | 2657590 | 10/2013 |
| WO | 2008099305 | 8/2008 |

OTHER PUBLICATIONS

Corresponding European Search Report for EP17165877 dated Aug. 31, 2017.

*Primary Examiner* — William J Carter
*Assistant Examiner* — Omar Rojas Cadima
(74) *Attorney, Agent, or Firm* — The Belles Group, P.C.

(57) ABSTRACT

A modular lighting system comprises at least one module comprising a rail elongated longitudinally along an axis where one or more lighting elements are placed and mounted reversibly onto the rail by magnetic coupling, drawing power from a printed circuit board on the rail by means of spring contacts.

20 Claims, 8 Drawing Sheets

(51) Int. Cl.
*F21Y 113/20* (2016.01)
*F21Y 115/10* (2016.01)

(56) References Cited

U.S. PATENT DOCUMENTS

| | | | | |
|---|---|---|---|---|
| 10,458,638 | B1 * | 10/2019 | Tirosh | H01R 25/145 |
| 2007/0153516 | A1 | 7/2007 | Lehman et al. | |
| 2007/0153550 | A1 * | 7/2007 | Lehman | F21V 21/35<br>362/648 |
| 2009/0086478 | A1 | 4/2009 | Sanroma et al. | |
| 2012/0075857 | A1 * | 3/2012 | Verbrugh | F21S 8/038<br>362/249.01 |
| 2013/0308324 | A1 * | 11/2013 | Zaderej | F21S 2/005<br>362/362 |

* cited by examiner

MODULAR LIGHTING SYSTEM

PRIORITY CLAIM

This application claims priority from Italian Utility Model Application No. 202016000037051 filed on Apr. 11, 2016, the disclosure of which is incorporated by reference.

TECHNICAL FIELD

The present innovation relates to a modular lighting system.

BACKGROUND OF THE INVENTION

Modular lighting systems consisting of lighting modules that can be variously connected to each other in different spatial configurations are known.

However, in general, it seems that there is still room for improvement in the known modular lighting systems, particularly as regards their versatility, assembly and simplicity to make.

For example, most of the known modular systems only allow the various modules to be assembled in one or two directions, consequently making it possible to have final configurations, which are substantially linear or two-dimensional.

Furthermore, the known modular systems can, at times, present difficulties related to their assembly, also requiring the use of tools.

SUMMARY OF THE INVENTION

It is therefore an object of the present invention to provide a modular lighting system, which is particularly simple to make and assemble, and which offers a wide variety of different configurations, also three-dimensional (in other words extending not only in two directions but in three directions).

The present innovation therefore relates to a modular lighting system, as defined in basic terms in the accompanying claim 1 and, in its additional aspects, in the dependent claims.

BRIEF DESCRIPTION OF THE DRAWINGS

Further characteristics and advantages of the present innovation will become clear from the description of the following non-limiting embodiments, with reference to the accompanying drawings, wherein.

DETAILED DESCRIPTION OF THE INVENTION

Figure 1:
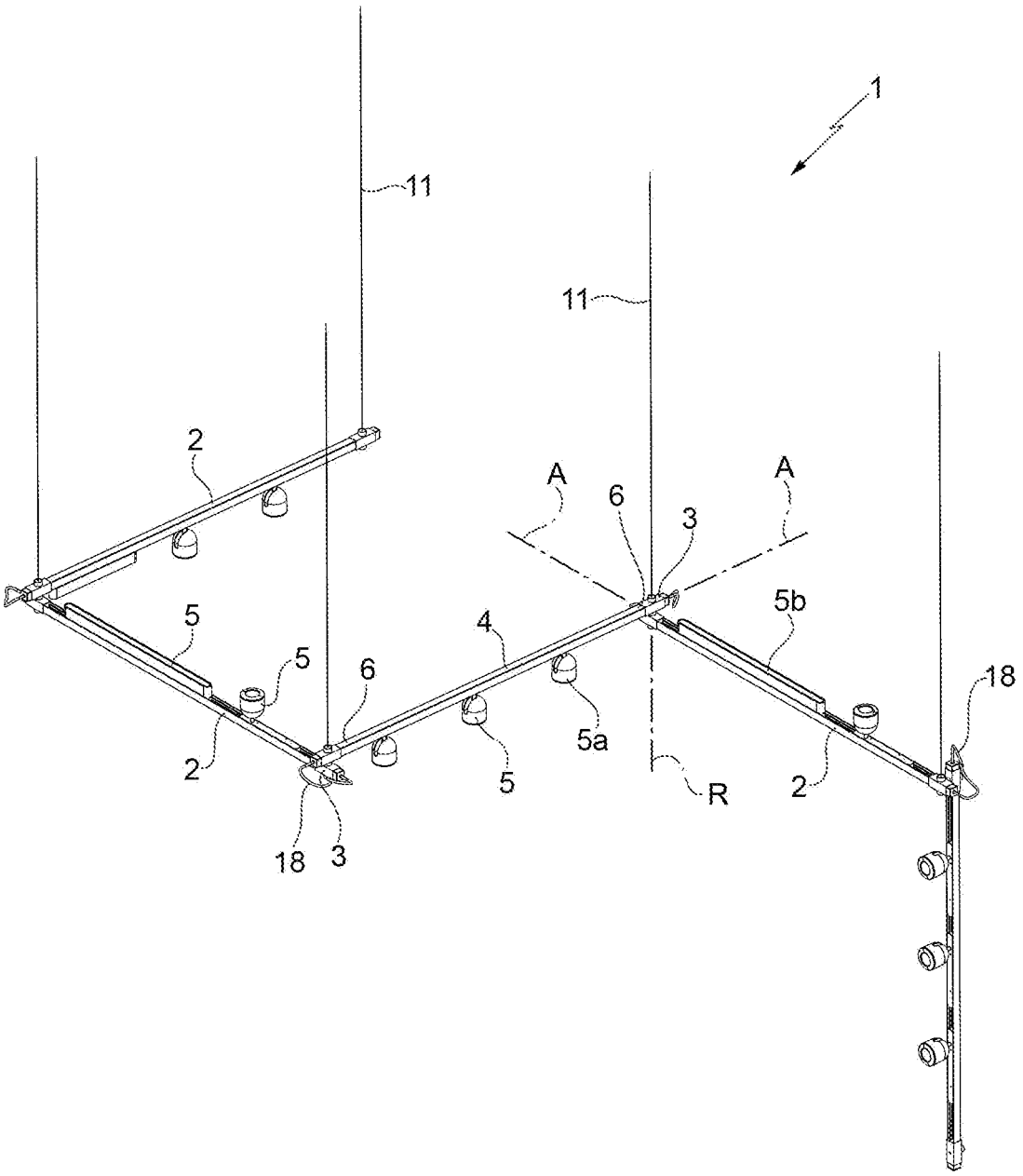
FIGS. 1 and 2 are two perspective schematic views, from above and from below, respectively, of a modular lighting system according to the invention, shown in an exemplary configuration.
Figure 2:
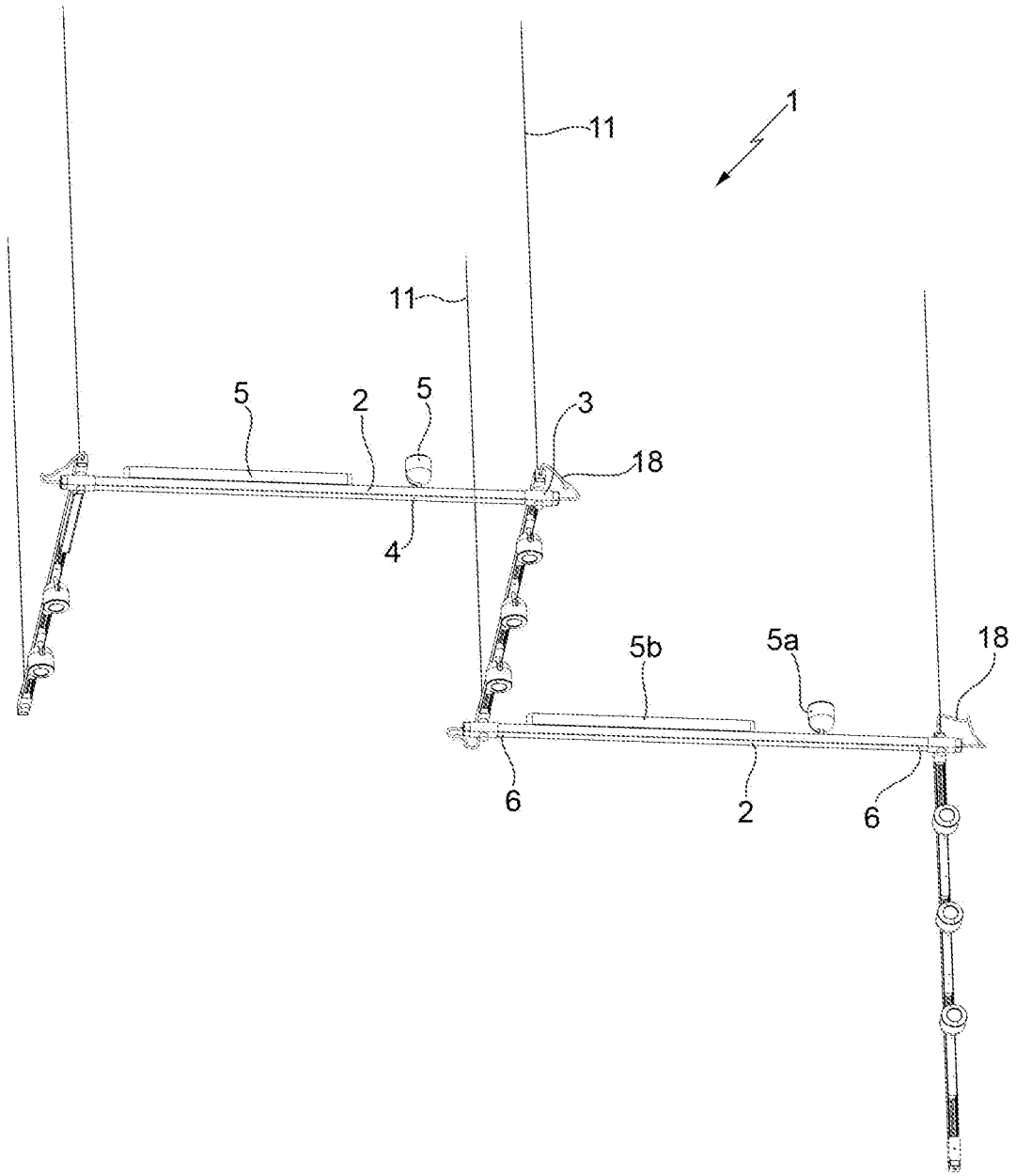

With reference to the FIGS. 1 and 2, a modular lighting system 1 comprises a plurality of combinable modules 2, joined by joints 3.

Each module 2 comprises a rail 4 elongated longitudinally along an axis A, where one or more lighting elements 5 are placed, which can be mounted reversibly onto the rail 4 by means of magnetic coupling. It is nonetheless understood that some rails 4 may also not include lighting elements 5.

The rails 4 extend along respective axes A between two opposite longitudinal ends 5 and are joined together by the joints 3.

Figure 3:
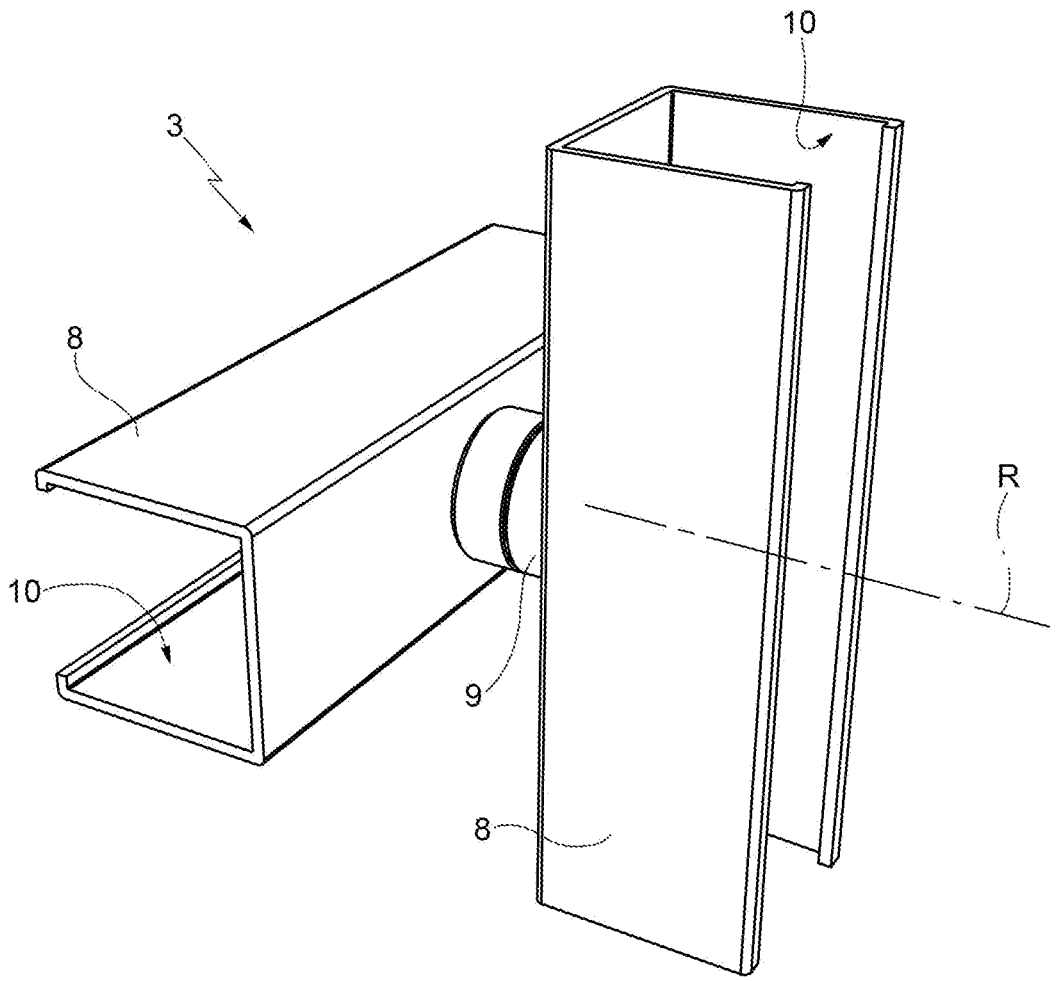
FIG. 3 is a perspective view of a component of the modular system in FIG. 1, in particular a joint.

Also with reference to FIG. 3, each joint 3 joins two rails 4 and comprises two bodies 8 joined to each other by a pin 9 that allows the two bodies to rotate in relation to each other around a rotation axis R defined by the pin 9.

The rotation axis R of a joint 3, which joins a pair of rails 4, is perpendicular to the axes A of the rails 4 joined by the joint 3.

Each body 8 has a seat 10 adapted so as to receive a longitudinal end 6 of a rail 4, which can be inserted axially into the seat 10. Each body 8 can be mounted onto a rail 4 with at least two directions orthogonal to each other. In other words, the rail 4 can be inserted into the seat 10 in at least two different positions, rotated by 90° in relation to each other around the axis A of the rail.

The rail 4 is preferably shaped as a square cross section and the seats 10 also present a square cross section. In this way, the rail 4 can be inserted into the seat 10 with four different directions.

The rail 4 slides axially in the seat 10 and is constrained transversally in the seat 10.

The joints 3 can present an open cross section (as shown in FIG. 3) or closed (as shown in FIGS. 1 and 2).

As shown in FIGS. 1, 2, advantageously, the joints are also used to support the system 1, for example to suspend the system 1 to a ceiling, by means of suspension cables 11 fixed to respective upper closure portions of the joints 3.

Figure 4:
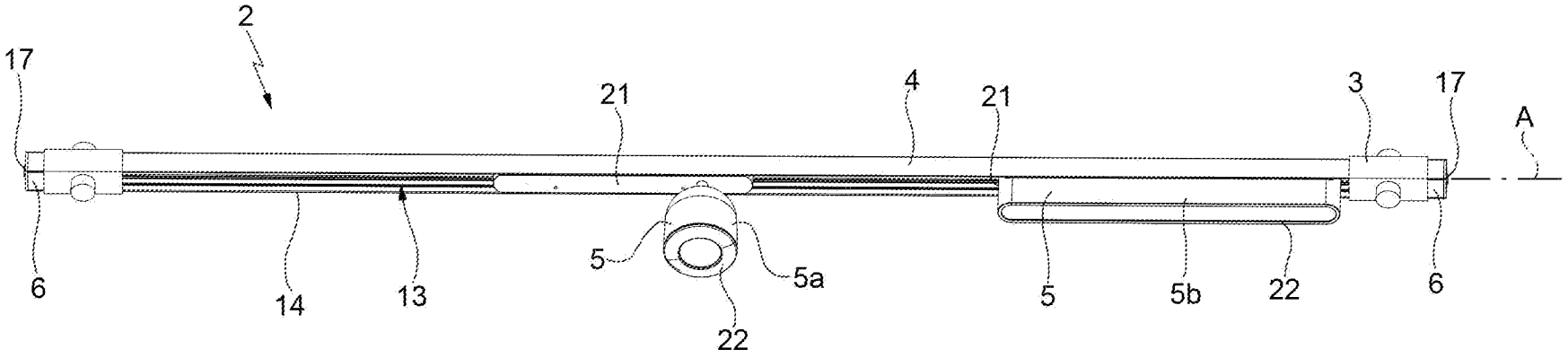
FIGS. 4 and 5 are a perspective view and a longitudinal section view, respectively, of a module of the modular lighting system in FIG. 1.
Figure 5:
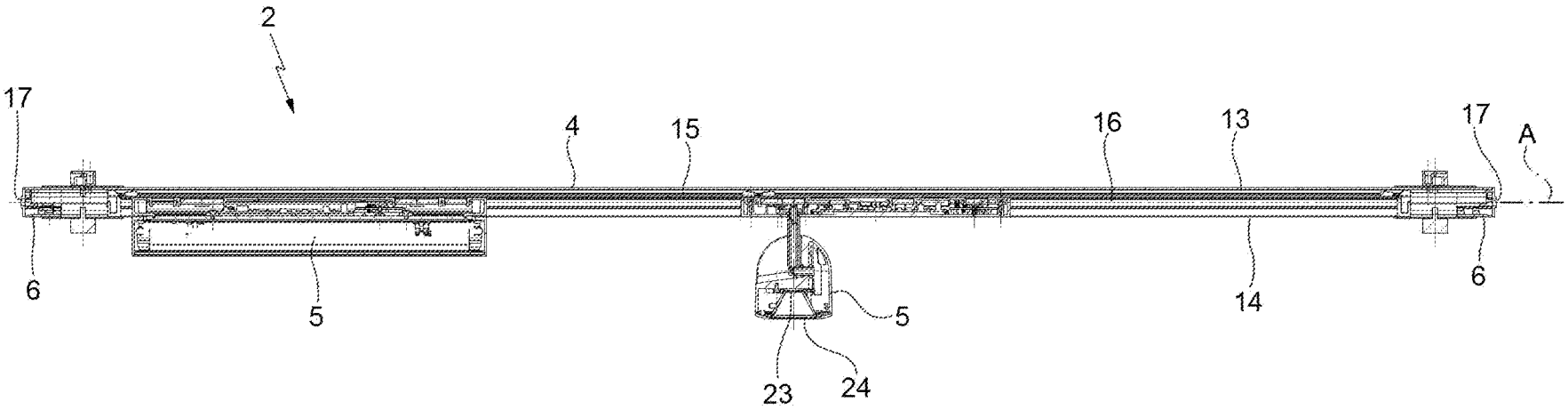

Also with reference to FIGS. 4 and 5, the rail 4 is shaped like a bar elongated longitudinally along the axis A.

As stated previously, the rail 4 has preferably a square shape in cross section.

The rail 4 is hollow internally and presents a longitudinal channel 13 having a front longitudinal aperture 14.

A back wall 15 of the channel 13, opposite the aperture 14, carries a printed circuit board 16 (PCB), which is arranged along the whole rail 4 and connected at the ends 6 of the rail 4 to respective terminals 17.

The printed circuit board 16 comprises conductor tracks, for example in copper, necessary for supplying and controlling the lighting elements 5, so as to allow electrification by contact of the lighting elements 5: the connection between each lighting element 5 and the printed circuit board 16 is magnetic thanks to the use of a magnetic material set behind the printed circuit board 16, and it can attract magnets, positioned on the lighting element 5.

Contact occurs and is guaranteed by spring contacts provided on the lighting elements 5, which draw power from the conductor tracks that run along the printed circuit board 16.

In this way, each lighting element 5 is connected to the rail 4 by magnetic coupling and an integrated electrical connection.

The conductor tracks are protected from oxidation thanks to a special conductive and protective finishing, made for example of graphite or galvanic gold-plating or other.

The system 1 can be supplied by an external power supply, or by a power supply that is mounted, in turn, onto a rail 4.

The electrical connection of the various modules 2 is guaranteed for example by connectors 18 (FIGS. 1, 2) that connect each pair of terminals 17 of modules 2 (in other words consecutive rails 4).

Figure 6:
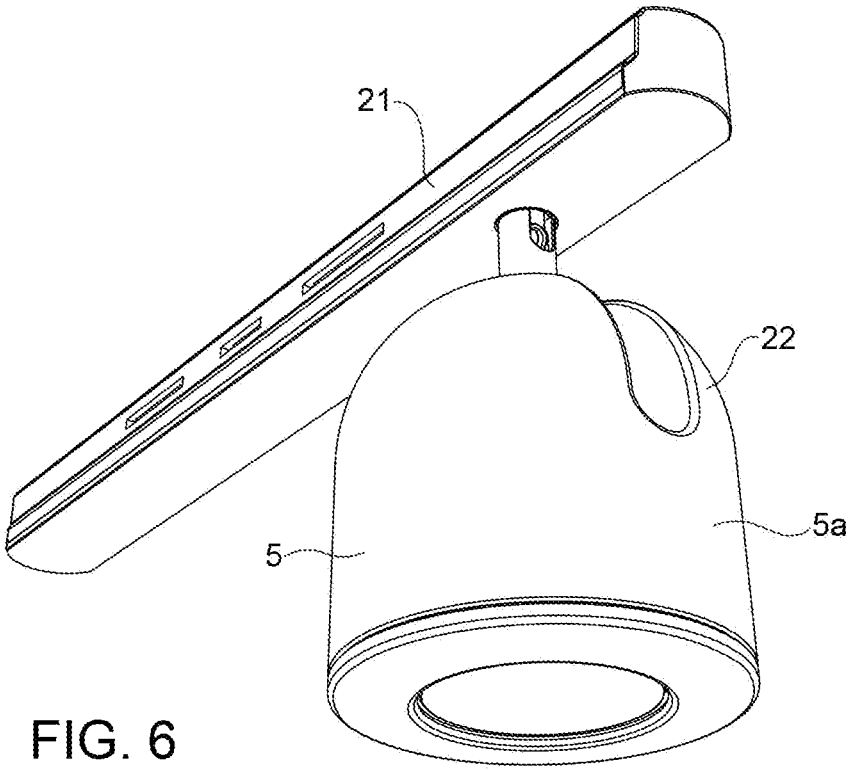
FIGS. 6 and 7 are two perspective schematic views of respective additional components of the modular lighting system in FIG. 1, in particular two differently shaped lighting elements.
Figure 7:
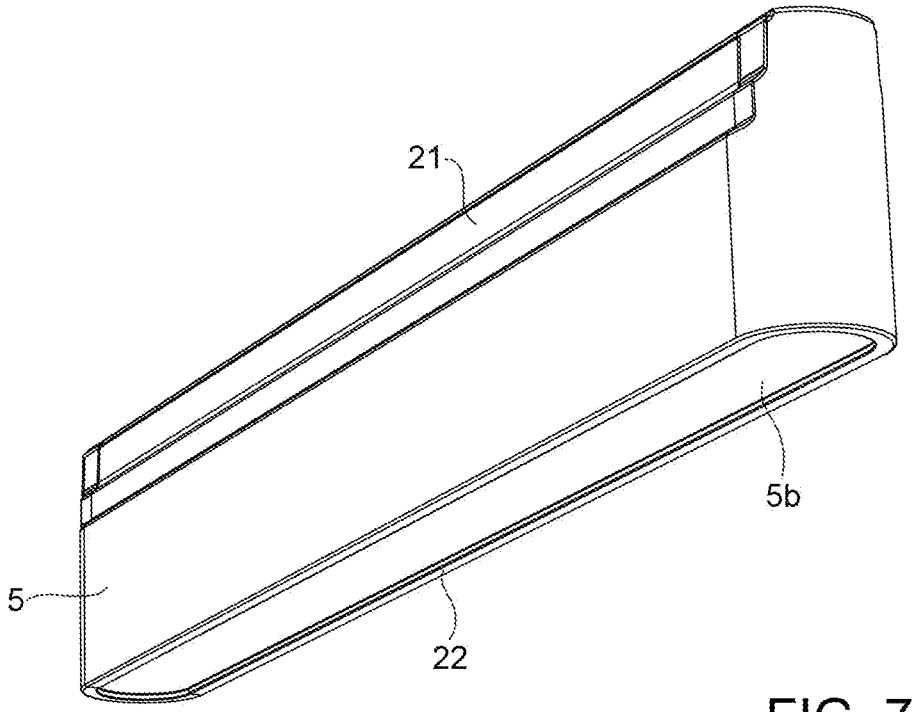

The system 1 can include different lighting elements 5. In the illustrated example, the system 1 comprises two types of lighting elements 5: an adjustable spotlight 5*a* (FIG. 6) and an elongated diffused light head 5*b* (FIG. 7). It is understood that other types of lighting elements 5 can be used, for example spotlights of different sizes and/or with different optical properties; diffused light heads of different lengths and/or shapes and/or with different emission characteristics; lighting elements of a completely different type; etc.

Each lighting element 5 comprises: a connection portion 21 that can be inserted into the channel 13 of a rail 4 through the aperture 14, which remains in use housed in the channel 13; and a lighting portion 22, which extends from the connection portion 21 and protrudes, in use, outside the channel 13.

The connection portion 21 carries the electrical contacts cooperating with the printed circuit board 16 of the rail 4 to supply the lighting element 5, and the magnets for the mechanical coupling of the lighting element 5 to the rail 4.

The lighting portion 22 comprises at least one light source 23 (FIG. 5), in particular a LED light source comprising one or mere LEDs, and an optical system 24 associated to the light source 23.

The lighting portion 22 is optionally connected to the connection portion 21 by an articulation (particularly in spotlight lighting elements 5).

Figure 8:
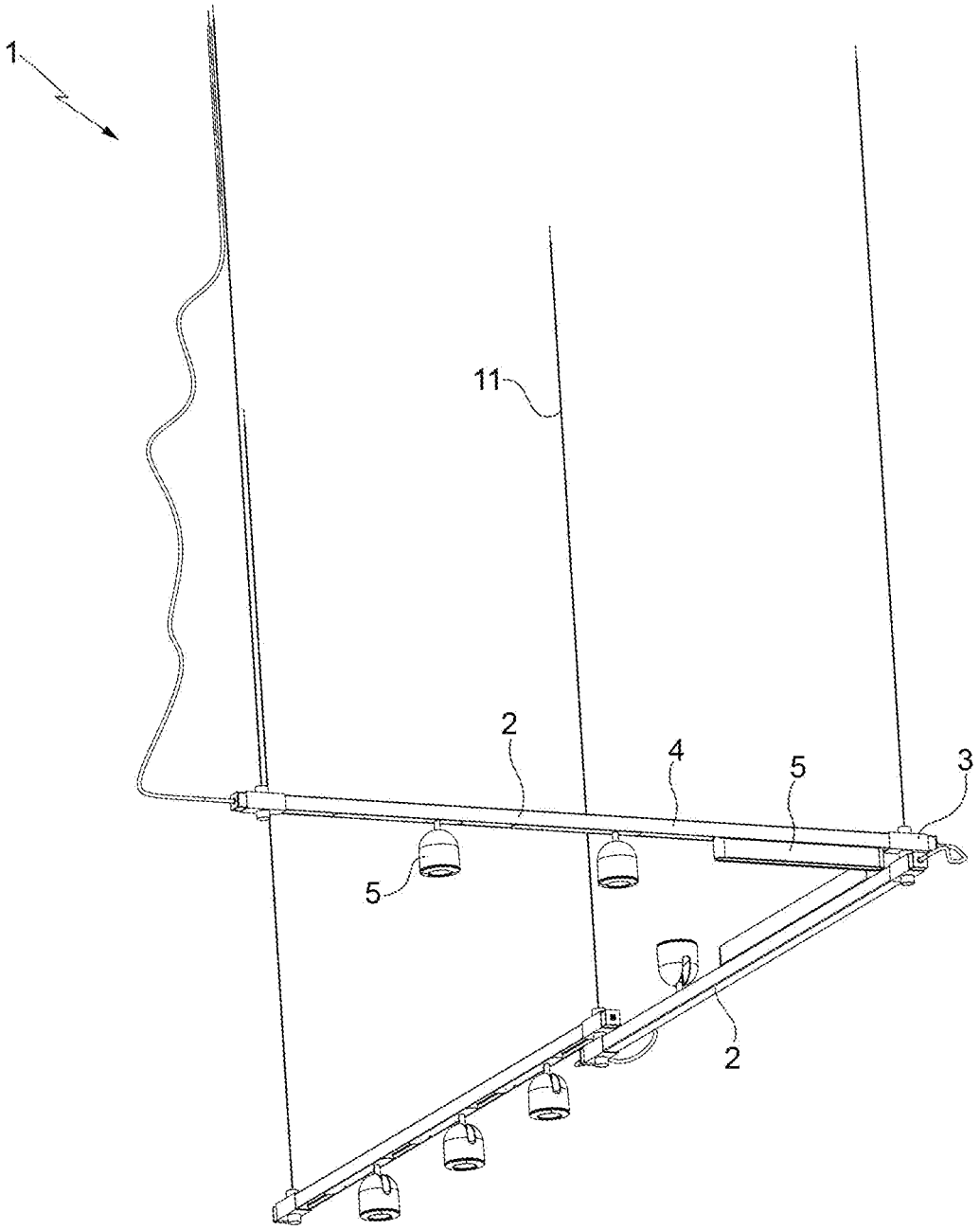
FIGS. 8 and 9 are respective perspective schematic views of further configurations of the modular lighting system according to the invention.
Figure 9:
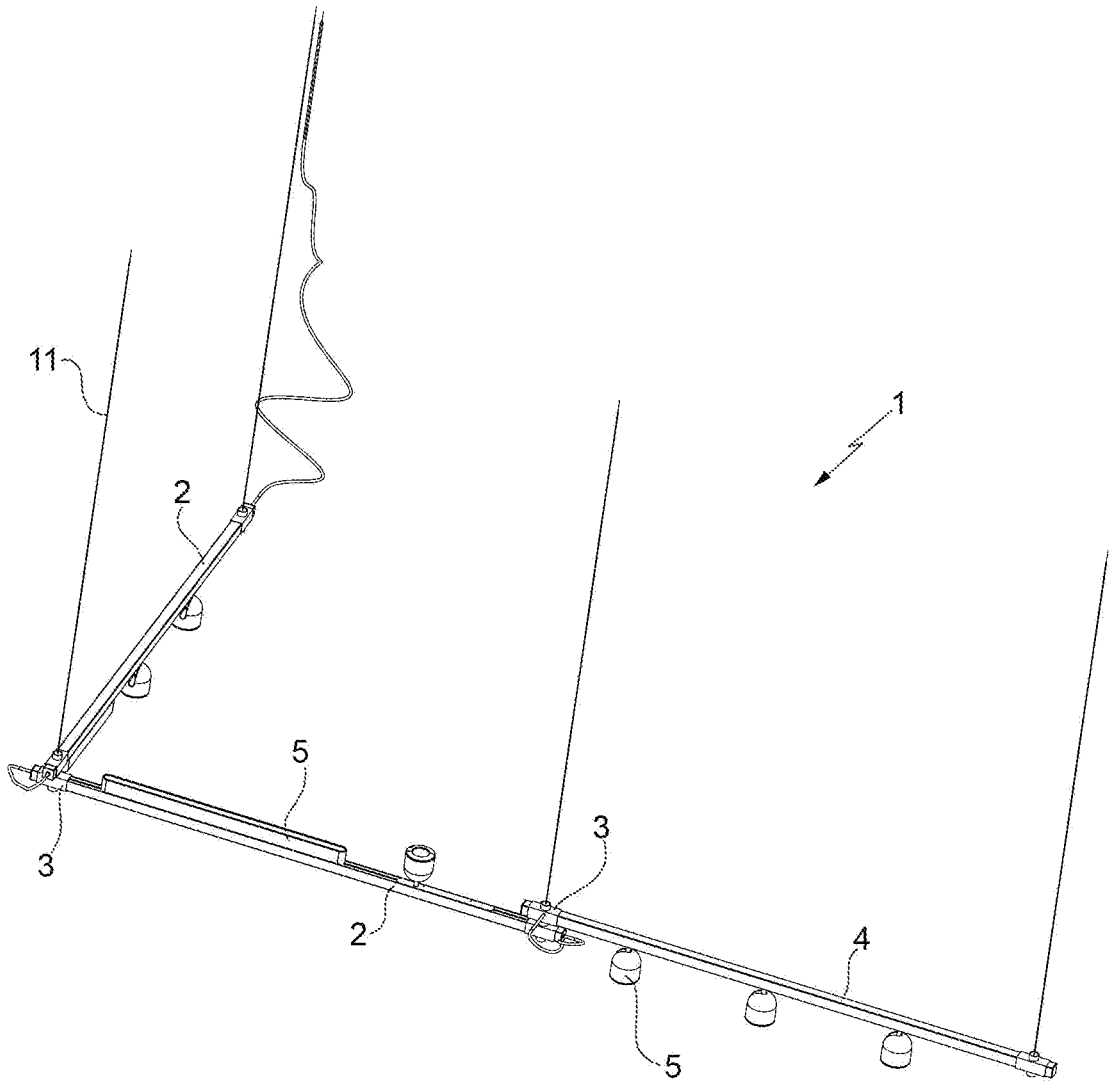

FIGS. 8 and 9 show further configurations, which can be adopted by the modular lighting system 1 of the invention.

It is clear from the illustrations and description that the system 1 can adopt multiple configurations. Starting with a few basic components (rails 4, joints 3, lighting elements 5), it is possible to create a system 1 of various shapes and sizes that is also three-dimensional.

Besides being able to mount the lighting elements 5 of a different type and required number onto each rail 4 and consequently onto each module 2, it is also possible to direct the lighting elements in four orthogonal directions, rotating the respective rail 4 in relation to the joints 3. The lighting elements 5 can therefore face upwards, downwards, to the right or to the left.

Furthermore, thanks to the joints 3, it is possible to connect the modules 2 with any angle: two modules 2 (in other words two rails 4) can be joined to each other with the respective axes A parallel, or perpendicular or in any case inclined. It is also possible to combine modules 2 both vertically and horizontally.

The system 1 can also include other types of accessory elements to be mounted onto the rails 4, advantageously again with magnetic coupling and integrated electrical connection by means of the printed circuit board 16: besides a power supply, as stated previously, and various types of lighting elements 5, the system 1 can include other accessory elements, such as sensors, command and interface elements, wireless connection elements, etc.

Finally, it is understood that further modifications and variations may be made to the modular lighting system described and illustrated here, which do not go beyond the scope of the accompanying claims.

The invention claimed is:

1. A modular lighting system comprising:

a rail elongated longitudinally along an axis where one or more lighting elements are placed and mounted on the rail by means of magnetic coupling;

a pin having a longitudinal pin axis;

wherein a joint comprises a first body having a first longitudinal axis and a second body having a second longitudinal axis joined to each other by the pin;

wherein the first longitudinal axis of the first body and the second longitudinal axis of the second body is separated from each other by the pin along the longitudinal pin axis, the pin being configured to allow the first and second bodies to rotate in relation to each other around a rotation axis defined by the pin;

wherein each body has a seat shaped so as to receive one longitudinal end of the rail, which is insertable into the seat with at least two directions that are orthogonal to each other;

wherein the rail comprises a first number of sides and the seat comprises a second number of sides; and wherein the one or more lighting elements are mountable on any of the first number of sides of the rail when the one longitudinal end of the rail is received in the seat.

2. The system according to claim 1, wherein axial ends of the pin comprise a first planar end and a second planar end, the first planar end contacting the first body and not contacting the second body.

3. The system according to claim 2, wherein an entire surface of the first planar end contacts the first body and an entire surface of the second planar end contacts the second body.

4. The system according to claim 1, wherein the one or more lighting elements being mountable on any of the first number of sides of the rail when the one longitudinal end of the rail is received in the seat allows the one or more lighting elements mounted on a single side of the rail to be directed in any of an upwards, downwards, left, or right direction when the one longitudinal end of the rail is received in the seat.

5. The system according to claim 1, wherein the first body and the second body are configured to rotate around the rotation axis defined by the pin irrespective of the other.

6. The system according to claim 1, wherein the rail comprises a first square cross section and the seat comprises a second square cross section, wherein the first square cross section of the rail and the second square cross section of the seat allow the rail to be received in the seat in one of four different directions.

7. The system according to claim 1, wherein the rail is internally hollow and presents a longitudinal channel having a front longitudinal aperture and a back wall opposite the aperture.

8. The system according to claim 7, further comprising a printed circuit board being arranged along the whole rail on said back wall and being connected, at opposite longitudinal ends of the rail, to respective terminals.

9. The system according to claim 8, wherein each lighting element comprises:

a connection portion, which can be inserted into the channel of the rail through the aperture and which remains, in use, housed in the channel; and a lighting portion, which extends from the connection portion and protrudes, in use, outside the channel.

10. The system according to claim 8, wherein a connection portion carries electrical contacts cooperating with the printed circuit board of the rail to supply a lighting element, and the magnets for mechanical coupling of the lighting element to the rail.

11. The system according to claim 1, wherein a lighting element is provided with spring contacts protruding from a connection portion of the lighting element to contact the conductor tracks of the printed circuit board; and magnets, placed in the connection portion to attract a magnetic material under the printed circuit board.

12. The system according to claim 1, wherein the rotation axis of the joint is perpendicular to the axes of the rail inserted into the seat.

13. The system according to claim 1, comprising accessory elements mounted onto the rails, with magnetic coupling and integrated electrical connection by means of the printed circuit board, the accessory elements comprising at least one of a power supply, one or more sensors, control and interface elements, or wireless connection elements.

14. A modular lighting system comprising:

a rail elongated longitudinally along an axis where one or more lighting elements are placed and mounted on the rail via a coupling;

wherein a joint joins at least two rails and comprises two bodies joined to each other by a pin, the pin completely separating the two bodies along a longitudinal axis of the pin, wherein the two bodies are configured to rotate around a rotation axis defined by the pin, the bodies of each joint being arranged at opposite axial ends of the pin along the rotation axis;

wherein each body has a seat shaped so as to receive a longitudinal end of the rail;

wherein the rail comprises a first number of sides and a first square cross section and the seat comprises a second number of sides and a second square cross section; and wherein the one or more lighting elements are mountable on any of the first number of sides of the rail when the one longitudinal end of the rail is received in the seat.

15. The system according to claim 14, wherein the axial ends of the pin comprise a first planar end and a second planar end, the first planar end contacting a first body of the two bodies and not a second body of the two bodies.

16. The system according to claim 14, wherein the first square cross section of the rail and the second square cross section of the seat allow the rail to be received in the seat in one of four different directions.

17. The system according to claim 14, wherein the rail is internally hollow and presents a longitudinal channel having a front longitudinal aperture and a back wall opposite the aperture.

18. The system according to claim 17, further comprising a printed circuit board being arranged along the whole rail on said back wall and being connected, at opposite longitudinal ends of the rail, to respective terminals.

19. The system according to claim 18, wherein each lighting element comprises:

a connection portion which can be inserted into the channel of the rail through the aperture and which remains, in use, housed in the channel; and a lighting portion which extends from the connection portion and protrudes, in use, outside the channel.

20. The system according to claim 14, comprising accessory elements mounted onto the rails, with magnetic coupling and integrated electrical connection by means of the printed circuit board, the accessory elements comprising at least one of a power supply, one or more sensors, control and interface elements, or wireless connection elements.

* * * * *